US009027312B2

(12) United States Patent
Zardini

(10) Patent No.: US 9,027,312 B2
(45) Date of Patent: May 12, 2015

(54) MACHINE AND METHOD FOR TREATING CONTAINERS OF LIQUIDS, AND LOADING DEVICE FOR SAID CONTAINERS

(75) Inventor: Fabio Zardini, Castelfranco Veneto (IT)

(73) Assignee: Steelco Spa, Riese Pio X (IT)

( * ) Notice: Subject to any disclaimer, the term of this patent is extended or adjusted under 35 U.S.C. 154(b) by 766 days.

(21) Appl. No.: 13/375,906

(22) PCT Filed: Jun. 1, 2010

(86) PCT No.: PCT/IB2010/001310

§ 371 (c)(1),
(2), (4) Date: Dec. 28, 2011

(87) PCT Pub. No.: WO2010/140043

PCT Pub. Date: Dec. 9, 2010

(65) Prior Publication Data

US 2012/0110952 A1 May 10, 2012

(30) Foreign Application Priority Data

Jun. 3, 2009 (IT) ..... UD2009A0112

(51) Int. Cl.

| | |
|---|---|
| ***B67C 7/00*** | (2006.01) |
| ***B65B 55/24*** | (2006.01) |
| ***B65B 7/28*** | (2006.01) |

(Continued)

(52) U.S. Cl.

CPC ..... *B65B 55/24* (2013.01); *B67B 3/064* (2013.01); *B67B 2201/06* (2013.01); *B67C 7/00* (2013.01); *B08B 3/022* (2013.01); *B08B 9/30* (2013.01); *B65B 7/2842* (2013.01)

(58) Field of Classification Search

CPC ..... B65B 55/24; B67C 7/00; B67B 3/06; B67B 3/064; B67B 3/0645; B67B 3/262; B67B 3/264; B67B 2201/06

USPC ..... 53/426, 471, 485, 167, 281, 282, 299, 53/306, 310, 312, 367

See application file for complete search history.

(56) References Cited

U.S. PATENT DOCUMENTS 2,340,639 A 2/1944 Brinton
2,695,125 A * 11/1954 Bowen ..... 53/299

(Continued)

FOREIGN PATENT DOCUMENTS

FR 2606006 A1 * 5/1988 ..... B67B 3/06
JP 3507584 B2 * 3/2004 ..... B67B 3/064

OTHER PUBLICATIONS

Int'l Search Report issued Nov. 22, 2010 in Int'l Application No. PCT/IB2010/001310; Written Opinion, 11 pages.

*Primary Examiner* — Stephen F Gerrity
(74) *Attorney, Agent, or Firm* — Panitch Schwarze Belisario & Nadel LLP

(57) ABSTRACT

Machine (10) and method for treating containers (12) of liquids comprising a loading station (15) into which baskets (23) are loaded containing, according to a desired pattern of disposition, the containers (12) to be subjected to washing, a filling station (18) in which the washed containers (12) are filled with new liquid, and a re-closing station (19) in which the containers (12) are closed by the relative lids (11). The re-closing station (19) comprises a closing device (63) provided with gripper members (70) by means of which the lids (11) are picked up and positioned so as to close the containers (12), and loading members (66) that automatically direct the lids (11) toward the closing device (63) in a manner consistent with the desired pattern of disposition of the containers (12) in the baskets (23). The closing device (63) comprises movement members (69) that move the gripper members (70) automatically between a pick-up position in correspondence with the loading members (66) and a position of closure in correspondence with the containers (12). The loading members (66) comprise stop elements (67), able to be selectively activated to automatically dispose the lids (11) in a manner consistent with the predetermined pattern of disposition of the containers (12).

14 Claims, 2 Drawing Sheets

(51) Int. Cl.

| | |
|---|---|
| ***B67B 3/06*** | (2006.01) |
| ***B67B 3/064*** | (2006.01) |
| ***B08B 3/02*** | (2006.01) |
| ***B08B 9/30*** | (2006.01) |

(56) References Cited

U.S. PATENT DOCUMENTS

| | | | | |
|---|---|---|---|---|
| 3,431,702 | A * | 3/1969 | Spaulding | 53/281 |
| 3,722,665 | A * | 3/1973 | Probasco | 198/689.1 |
| 5,050,367 | A | 9/1991 | Heisler | |
| 5,493,849 | A * | 2/1996 | Itoh | 53/367 |
| 6,205,743 | B1 * | 3/2001 | Castellari | 53/281 |
| 6,971,216 | B2 * | 12/2005 | Monti | 53/310 |
| 2003/0056466 | A1 | 3/2003 | Muneyasu | |
| 2004/0123561 | A1 * | 7/2004 | Monti | 53/247 |

* cited by examiner

MACHINE AND METHOD FOR TREATING CONTAINERS OF LIQUIDS, AND LOADING DEVICE FOR SAID CONTAINERS

CROSS-REFERENCE TO RELATED APPLICATION

This application is a Section 371 of International Application No. PCT/IB2010/001310, filed Jun. 1, 2010, which was published in the English language on Dec. 9, 2010, under International Publication No. WO 2010/140043 A2, and the disclosure of which is incorporated herein by reference.

FIELD OF THE INVENTION

The present invention concerns a machine and a method for treating in an automated manner containers of liquids, for example, but not exclusively, bottles, feeding bottles, watering troughs or other containers or recipients to feed animals. In particular, with the present invention it is possible to wash, rinse, fill and re-close the containers in a substantially automated manner, and with the minimum manual intervention of an operator.

BACKGROUND OF THE INVENTION

Machines are known which are used for washing containers of liquids, such as but not only, bottles, feeding bottles, watering troughs or others, used for feeding animals, such as for example guinea pigs or laboratory rodents or others.

It is known that, before washing, the containers are closed by suitable lids, or capsules; the lids are shaped with a lip to allow the animal to consume the liquid contained in the container, and the containers must be provided at the end of washing closed and filled with new liquid.

It is known to provide machines for washing the containers, which are structured with a support frame provided with a base resting on the ground and with a plurality of operating stations disposed in line with respect to each other, including a loading station for the closed containers, a station for removing the capsules from the containers, or de-lidding station, a washing station, a filling station and one to re-close the containers which have been washed and filled, by means of said capsules.

In the known machines, except for the washing station, in which the containers are closed in a washing chamber and undergo predetermined automated washing and rinsing steps, the remaining stations need considerable manual interventions and attention from the operators, in particular for loading, for positioning the containers in the filling station and for re-closing with the lids the containers which have been washed and filled.

These manual operations entail an increase in the overall times of the whole process of washing and filling the containers, as well as the need to employ different operators for the same machine, with a consequent increase in management costs.

Furthermore, the manual intervention may not always be precise and repeatable and may entail the risk of accidents for the operators.

It is also known to dispose and group together a plurality of containers in suitable washing baskets, so as to hold the containers in a desired disposition during all the operating steps of the machine.

It is also known to provide that the baskets define a plurality of containing cells for the containers, conformed to prevent the accidental exit of the containers from the basket, so as to be able to provide the upending of the basket inside the washing chamber, for example to facilitate dripping after the washing and rinsing step.

One of the manual operations which most entails an increase in the times and management costs of known machines is the step of re-closing the washed containers with the lids.

The lids are normally constrained in an air-tight manner to the containers, by means of suitable pneumatic positioners, associated with the re-closing station. In this station the lids are removed by the operator one at a time from a relative containing box and are then temporarily attached to the positioner, and are then constrained, one at a time or in small groups, to the containers.

In different known solutions, the operations of removing the lids from the basket, positioning them and temporarily attaching them to the positioner, and also constraining them to the containers, are carried out manually with a consequent increase in times and costs of management of the machine, and possible inaccuracies.

Solutions are also known in which at least the positioning and the temporary attachment of the lids to the positioner at least occur in a guided manner. Nevertheless, manual intervention by the operator is needed in order to move the positioner, to constrain the lids to the containers, as well as to remove the lids.

A device for filling and closing containers is known and described in the US patent application US-A-2003/0056466.

One purpose of the present invention is to produce a machine, and perfect a method, which allows to remove the lids or capsules, to wash, fill and re-close the containers in a simple, economic and efficient way, in a substantially automated manner and reducing to a minimum the manual interventions of the operators.

Another purpose of the present invention is to perfect a device which allows to load the lids of the containers reducing the execution time to a minimum and providing in an automated way all the operations needed for this operation The Applicant has devised, tested and embodied the present invention to overcome the shortcomings of the state of the art and to obtain these and other purposes and advantages.

SUMMARY OF THE INVENTION

The present invention is set forth and characterized in the independent claims, while the dependent claims describe other characteristics of the invention or variants to the main inventive idea.

According to one feature of the present invention, a machine for treating containers of liquids comprises:

a loading station, in which baskets containing containers to be subjected to treatment are loaded, disposed in the baskets according to a predetermined, desired pattern of disposition;

a washing station, in which the containers are subjected at least to washing;

a filling station in which the washed containers are filled with a new liquid;

a re-closing station in which the containers are re-closed with relative lids.

According to the present invention, the re-closing station comprises a closing device provided with gripping members by means of which the lids are taken and positioned so as to close the containers, and loading means able to automatically direct the lids toward the closing device in a manner consistent with said desired predetermined pattern of disposition of the containers in the baskets. The closing device comprises movement means able to automatically move said gripping members between a pick-up position in correspondence with said loading means and a position for closing the lids in correspondence with said containers.

According to a characteristic feature of the present invention, the loading means comprise stop elements which can be selectively activated in order to automatically dispose the lids in a consistent manner according to the predetermined pattern of disposition of the containers.

The present invention allows to remove the lids or capsules, to wash, fill and re-close the containers in a simple, economic and efficient way, in a substantially automated manner and reducing to a minimum the manual interventions of the operators.

In particular, thanks to said movement means of the gripping members of the closing device and to the stop elements, the present invention allows to automatically re-close the containers, reducing execution times to a minimum and providing in an automated manner all the operations necessary for this operation.

According to a variant, the re-closing station comprises containing means, able to contain the lids to be re-positioned; the containing means are operatively associated with pick-up means able to automatically pick up and transport the lids from the containing means toward the loading means.

According to a variant, the loading means are configured to feed the lids in a direction substantially parallel to the direction of feed of the baskets along the washing machine.

According to a variant, the loading means comprise at least a conveyor belt conformed to move the lids until they cooperate with the stop elements.

According to a further form of embodiment, the loading means comprise a vibrating feed plane toward the closing device.

According to a variant, each of the stop elements comprises at least a linear actuator disposed in cooperation with the loading means in order to intercept a determinate lid and stop it in a predetermined position according to the pattern of disposition of the containers.

According to another variant, sensor means are provided in cooperation with the stop elements in order to identify the actual position of the containers, and to actuate the selective activation of the stop elements.

According to a further variant, the movement means comprise a translation slider associated with the gripping members, to determine a movement of the gripping members in a direction transverse to the direction of feed of the baskets along the washing machine.

The machine according to the present invention can comprise movement means able to determine the movement of the baskets along the direction of feed of the washing machine, through the various stations. According to one form of embodiment, the closing device is mounted suspended on a bridge structure above the movement means; the bridge structure is provided with linear guides transverse to the direction of feed along the machine, and the sliding defined by the movement means is made along said linear guides.

An advantageous variant of the present invention provides that the gripping members of the closing device are grouped and disposed in a consistent manner according to the pattern of disposition of the lids determined by the loading means.

According to one form of embodiment, the gripping members are selectively movable in a vertical direction, by means of relative actuator means, in order to pick up the lids from the loading means and to subsequently position the lids on the relative containers.

Another feature of the present invention concerns a closing device to re-close the containers with relative lids in a machine for treating containers of liquids. The closing device comprises gripping members which automatically pick up and position the lids so as to close the containers, and movement means able to automatically move said gripping members between a pick-up position, in which the lids are disposed according to a desired, predetermined pattern, and a closing position of the lids in correspondence with said containers.

Another feature of the present invention concerns a method for treating containers of liquids comprising:

a first step in which baskets containing the containers to be subjected to treatment are loaded, said containers being disposed in the baskets according to a desired, predetermined pattern of disposition;

a second step in which the containers are subjected to washing;

a third step in which the washed containers are filled with new liquid;

a fourth step in which the containers are re-closed with relative lids.

According to the present invention, the fourth step, by means of loading means, provides to automatically dispose the lids in a manner consistent with said desired, predetermined pattern of disposition of the containers in the baskets, to pick up and position the lids thus disposed, by means of a closing device provided with gripping members, in order to close the containers.

The gripping members are moved automatically, by means of movement means, between a pick-up position in correspondence with said loading means and a position for closing the lids in correspondence with said containers.

BRIEF DESCRIPTION OF THE DRAWINGS

These and other characteristics of the present invention will become apparent from the following description of a preferential form of embodiment, given as a non-restrictive example with reference to the attached drawings wherein.

DETAILED DESCRIPTION OF A PREFERENTIAL FORM OF EMBODIMENT

Figure 1:
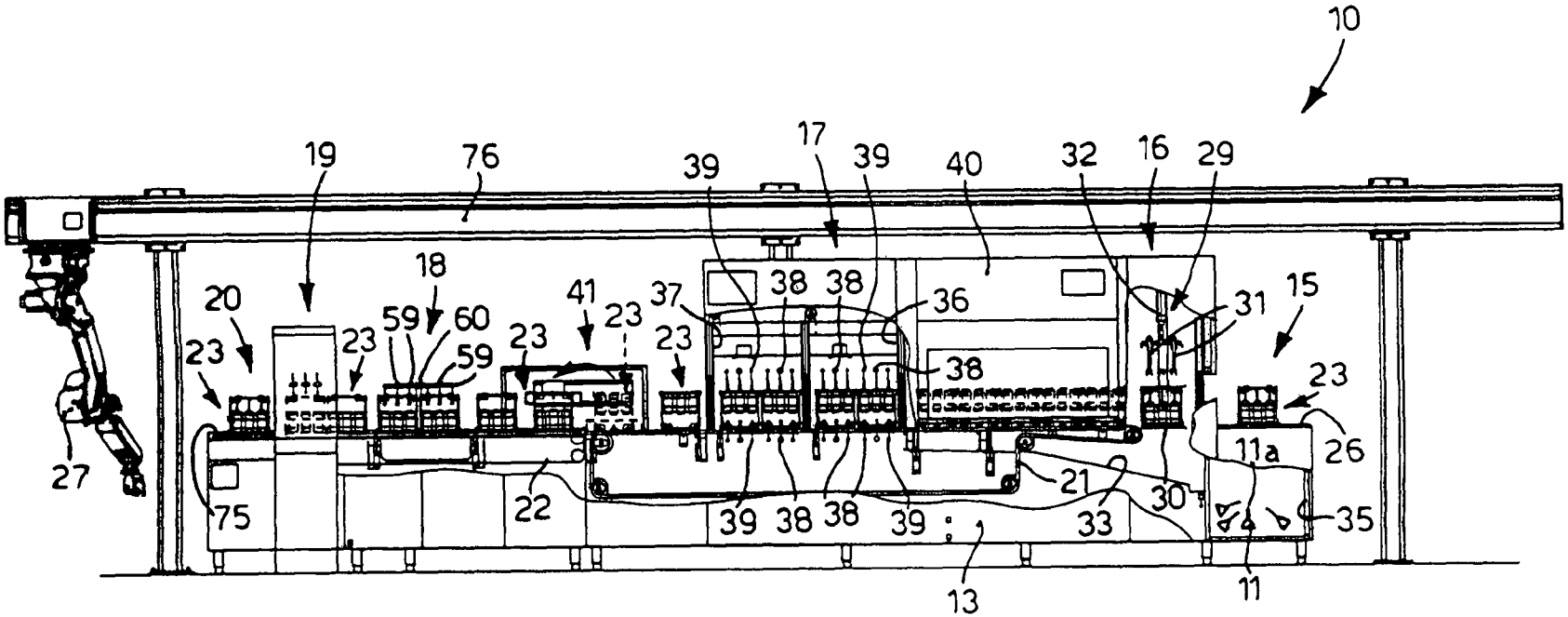
FIG. 1 shows schematically a lateral view of a machine for treating containers of liquids according to the present invention.

With reference to the attached drawings, a machine 10 according to the present invention can be used for the treatment of feeding bottles 12 in order to feed small animals, such as guinea pigs, mice, hamsters and others, used for example in pharmaceutical research laboratories.

The feeding bottles 12 are normally closed at the top by means of relative lids 11, or capsules, made of metal and conformed to define a lip 11*a* from which the animal consumes the liquid contained therein.

In particular the machine 10 according to the present invention allows to de-lid, wash, fill and re-close the feeding bottle 12 in an automated way.

The treatment machine 10 comprises a frame 13, with respect to which a loading station 15, a de-lidding station 16, a washing station 17, a filling station 18, a re-closing station 19 and an unloading station 20 are disposed in sequence.

The movement of the feeding bottles 12 between said stations 15, 16, 17, 18, 19 and 20 occurs by means of two conveyor belts, respectively a first 21 and a second 22, disposed one after the other in a determinate direction of feed X.

In particular the first belt 21 allows the movement of the feeding bottles 12 between the loading station 15, the de-lidding station 16 up to the exit from the washing station 17, while the second conveyor belt 22 moves the feeding bottles 12 between the filling station 18, the re-closing station 19 and the unloading station 20.

In this case the feeding bottles 12 are disposed inside relative containing baskets 23, which are typically provided with a plurality of cells 25: the cells 25 have a desired ordered disposition, for example in rows or columns. Each cell 25 is conformed to house a relative feeding bottle 12 and hold it in a determinate ordered position with respect to the other feeding bottles 12.

In this case the cells 25 are conformed to allow the positioning of the feeding bottles 12 and to prevent them from accidentally coming out, in particular in an upended condition at 180° of the containing basket 23.

In fact, during the washing of the feeding bottles 12, the containing basket 23 is rotated, as will be explained hereafter in more detail, between two rotated positions one at 180° with respect to the other.

The loading station 15 comprises a loading plane 26 on which the baskets 23 containing the feeding bottles 12, dirty and closed with the lid 11, are disposed.

The progressive positioning of the baskets 23 on the loading plane 26 is carried out in an automated way by means of an anthropomorphic robot 27.

The de-lidding station 16 is downstream of the loading station 15 and comprises a member 29 to extract the lids 11, and an upending device 30 to upend the baskets 23.

In this case, the extractor member 29 comprises a plurality of extraction heads 31 of the pneumatic type and movable vertically by means of a linear actuator 32; the extraction heads 31 cooperate with the lips of each lid 11 in order to blow in pressurized air into the feeding bottles 12 and cause the release of the lids 11 from the relative feeding bottles 12. The extraction heads 31 are provided singly or in groups and act automatically on the lips 11*a* of the lids 11 according to the positioning pattern of the feeding bottles 12 in the basket 23.

The upending device 30 rotates the basket 23 through 180° after the release of the lids 11, so that in an upturned condition of the feeding bottles 12, that is, with the relative aperture open toward the bottom, the lids 11 fall due to gravity onto a slide 33 provided on a lower part of the frame 13.

The lids 11 are directed along this slide 33 and collected in relative containing boxes 35, provided, in this case, to limit the bulk, below the loading plane 26.

The upended baskets 23 are progressively moved by the first belt 21 to reach the washing station 17. During this movement, facilitated by the upended position, the residual liquids in the feeding bottles 12 tend to exit due to gravity.

The washing station 17 comprises a first chamber 36 and a second chamber 37, in this case separated from each other.

It is not excluded that according to some variants, the first chamber 36 and the second chamber 37 can be integrated into one single chamber, just as more than two washing chambers can be provided.

Both inside the first chamber 36 and inside the chamber 37 a plurality of first nozzles 38 and second nozzles 39 are disposed, on the opposite side with respect to the first belt 21.

In this case the first nozzles 38 are able to deliver a washing liquid toward the feeding bottles 12, while the second nozzles 39 are able to deliver a rinsing liquid toward the feeding bottles 12.

In a solution in which in each chamber 36 and 37 both types of nozzles 38 and 39 are provided, the feeding bottles 12 contained in each basket 23 substantially are subjected to two repeated cycles of washing and rinsing.

In an alternative solution in which only first nozzles 38 are provided in the first chamber 36 and only second nozzles 39 are provided in the second chamber 39, the feeding bottles 12 contained in each basket 23 are subjected to only one washing cycle which has longer and more intense steps.

One, the other or both these operating solutions can be chosen on each occasion depending on the type of washing to be carried out and/other operating parameters.

According to another variant only one washing chamber for the two steps of washing and rinsing can be provided; the basket 23 containing the feeding bottles 12 enters into said single washing chamber.

According to a variant the baskets 23 go into the two chambers 36 and 37, that is, into the single chamber, one at a time or in pairs or more, so as to reduce the step time.

According to another variant, the baskets 23 stay inside the chambers 36 or 37, or in the single chamber, for the time needed for the treatment, or for the treatments provided, providing a step-wise movement of the first belt 21.

According to a further variant, the first belt 21 moves the baskets 23 inside the chambers 36 or 37 continuously or without stopping, at a speed coordinated to the process times.

In this case, the de-lidding station 16 and the washing station 17 are included and contained inside a single closed cabin 40, which isolates said stations 16 and 17 from the outside environment in order to prevent the spilling of liquids and contamination of the work environment.

Outside the cabin 40, between the washing station 17 and the filling station 18, substantially in correspondence with the zone in which the first belt 21 and the second belt 22 meet, a manipulator device 41 to manipulate the baskets 23 is provided. The manipulator device 41 is suitable to automatically rotate the baskets 23 exiting from the washing station 17 by 180°, in order to return the feeding bottles 12 contained therein with their relative apertures open toward the top.

The upended baskets 23 are positioned by the manipulator device 41 on the second belt 22, which positions them in correspondence with the filling station 18.

The filling station 18 comprises a plurality of filling nozzles 59, which are disposed in suspension above the belt 22 at a height which is higher than that of the baskets 23.

In particular the filling nozzles 59 are assembled on a frame 60, which is also conformed so as to dispose the filling nozzles 59 according to the positioning pattern of the feeding bottles 12 inside the baskets 23.

In this way, each feeding bottle 12 is filled from above substantially without any liquid being wasted and guaranteeing great precision, uniformity and completeness in the filling.

Advantageously the filling nozzles 59 are operatively associated with timer and/or flow control means, of the substantially known type and not shown in the drawings, which allow to carry out a filling of the feeding bottles 12 with a predetermined quantity of filling liquid. This solution allows to completely automate the filling steps, preventing overflowing of the feeding bottles 12.

The filled feeding bottles 12 are brought to the re-closing station 19 which, in an automated manner, repositions the lids 11 on the relative feeding bottles 12 and hermetically attaches them.

Figure 2:
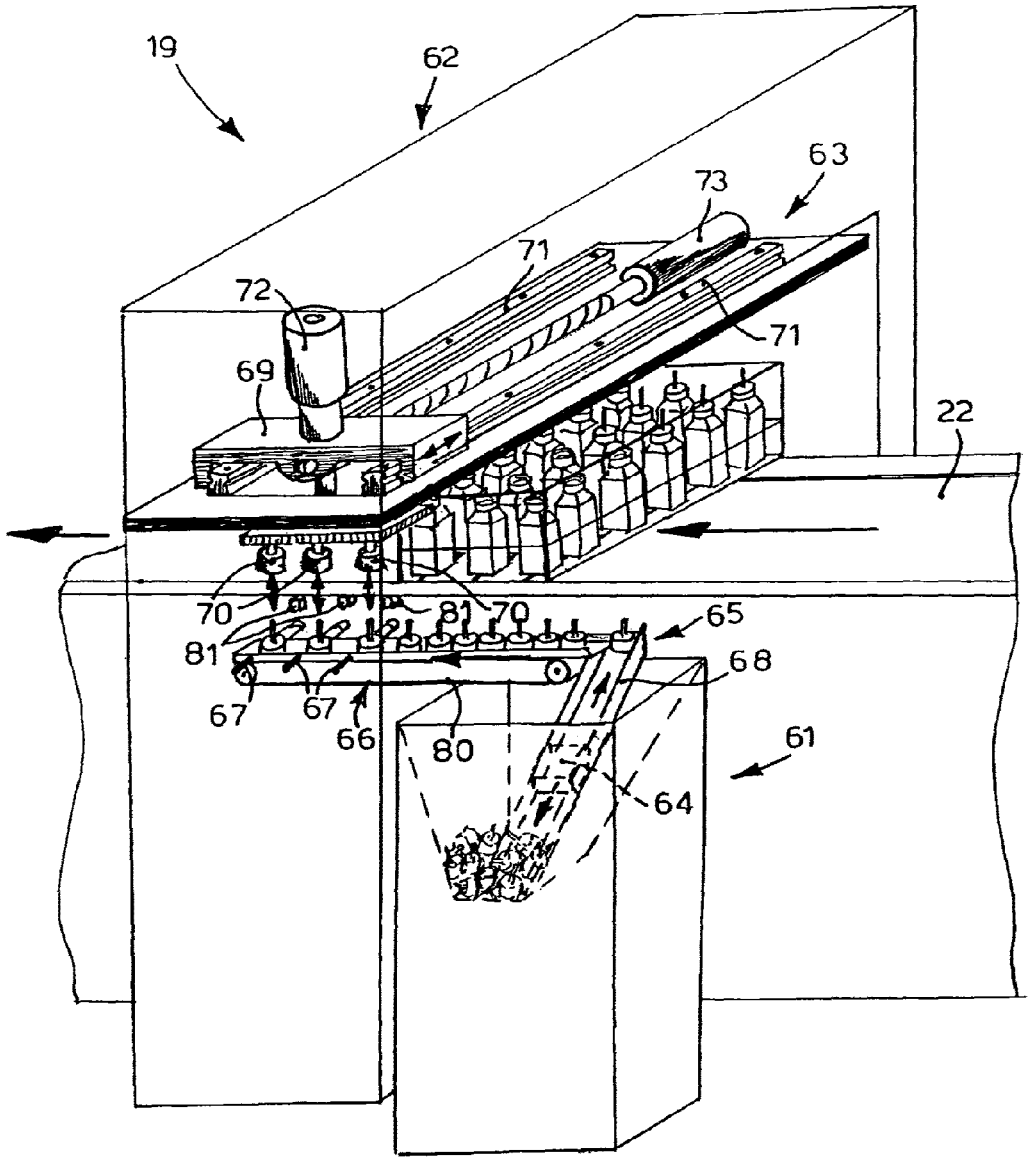
FIG. 2 shows an enlarged detail of the machine in FIG. 1, in a possible operating condition.

With particular reference to FIG. 2, the re-closing station 19 comprises a hopper 61 containing new lids 11, that is, treated lids 11 which have been subjected to ultrasound washing or other washing, and rinsed so as to be attached to the feeding bottles 12, and a bridge structure 62 which supports a closing device 63, above the second belt 22. The closing device 63 is able to automatically close the feeding bottles 12 by means of the relative lids 11.

A pick-up member 65 is operatively associated with the hopper 61, and is able to automatically take the lids 11 from the hopper 61 and position them, according to a desired order, on a loading device, such as a feed plane 66.

The feed plane 66 comprises a conveyor belt 80, which feeds the lids 11 toward the closing device 63 in a direction substantially parallel to the direction of feed X of the baskets 23 along the washing machine 10.

According to one form of embodiment, given as a non-restrictive example of the present invention, the pick-up member 65 comprises a cursor element 64 mobile or sliding along a guide or runner 68 which extends from inside the hopper 61 toward the feed plane 66.

The cursor element 64 picks up the lids 11 singly or in groups inside the hopper 61 and transports and deposits them in correspondence with the conveyor belt 80 of the feed plane 66, from where they are then fed toward the closing device 63.

In this case, the cursor element 64 is provided with a housing portion able to house the lid or lids in a desired position, univocal and predetermined. In particular, the housing portion of the cursor element 64 is conformed to determine a positioning of the lid 11 with the lip 11*a* facing upward, in particular once the lid 11 is deposited on the conveyor belt 80 of the feed plane 66. It is thus guaranteed that the lids 11 are fed in the desired and correct position, coordinated with the subsequent operation to re-close the feeding bottles 12.

The conveyor belt 80 is disposed at the side of the second belt 22 and, by means of relative linear stop actuators 67, allows to automatically dispose the lids 11 in a consistent manner according to the distances provided for the feeding bottles 12 inside the basket 23.

In fact, the linear actuators 67 act in a direction transverse to the direction of feed imposed by the conveyor belt 80, so as to selectively intercept the movement of the lids 11, and to stop them in a relative and predetermined position, advantageously coordinated with the position of the feeding bottles 12 inside the baskets 23.

In this case, in correspondence with each linear actuator 67 an optical sensor 81 is provided, which identifies the position of the lids 11 in movement and commands the selective actuation of the relative linear actuator 67.

In this way, the closing device 63, already configured consistently with the disposition of the feeding bottles 12 in the baskets 23, can easily pick up groups of lids 11 automatically, advantageously with the lip 11*a* facing upward and distanced from each other with respect to the linear actuators 67 according to distances coordinated with the baskets 23, so as to proceed with closing the feeding bottles 12.

According to a variant, the feed plane 66 is a vibrating plane, to allow a progressive feed of the lids 11 toward the stop actuators 67 and the closing device 65.

In particular, the closing device 63 comprises a positioning slider 69 mounted cantilevered and able to slide transversely, in this case perpendicularly as indicated by the arrow F, with respect to the direction of feed X defined by the second belt 22 and provided with a plurality of gripping heads 70, facing downward, in order to pick up the lids 11, advantageously in ordered groups, and dispose them to close the feeding bottles 12. The positioning slider 69 thus moves the gripping heads 70 in a direction transverse, in this case perpendicular, to the direction of feed X of the baskets 23 along the washing machine 10.

The gripping heads 70 are disposed according to the positioning pattern and the distances at which the feeding bottles 12 are disposed in the basket 23 and at which the lids 11 are maintained on the feed plane 66, by the linear actuators 67.

The gripping heads 70 are selectively movable in a substantially vertical direction by means of a relative actuator 72, so as to be able to be lowered and raised in order to pick up, support and position the lids 11 during the closing of the feeding bottles 12.

In this case, the positioning slider 69 is mounted sliding on the bridge structure 62 by means of relative linear guides 71 transverse, in this case perpendicular, to the direction of feed X along the machine. The selective movement of the positioning slider 69 is actuated by a mechanical actuator 73, in this case a screw, for example with recirculating balls, directly connected to the positioning slider 69.

Once the steps of closing all the feeding bottles 12 contained in a basket 23 have finished, the second belt 22 transports the basket 23 toward the unloading station 30, positioning it on a relative unloading plane 75.

The baskets 23, thus positioned, are picked up by the anthropomorphic robot 27 and positioned in relative discharge sliders, of a known type and not shown.

The anthropomorphic robot 27 is mounted movable on a track 76 disposed above the operating stations 15, 16, 17, 18, 19 and 20, and extending for the whole length of the frame 13, in order to carry out both the operations of loading the baskets 23 with the feeding bottles 12 to be washed and filled, and also the unloading of the baskets 23 with the feeding bottles 12 which have been washed and filled.

According to a variant, two anthropomorphic robots 27 are provided, respectively, one for loading the baskets 23 with the feeding bottles 12 to be washed and filled, and one for unloading the baskets 23 with the feeding bottles 12 which have been washed and filled.

It is clear that modifications and/or additions of parts or steps may be made to the treatment machine 10, to the method and to the closing device 63 as described heretofore, without departing from the field and scope of the present invention.

For example it comes within the scope of the present invention to provide a control and command unit of the programmed and programmable type, which is electronically connected to each of the operating stations 15, 16, 17, 18, 19 and 20, and/or to the remaining command members provided, in order to selectively coordinate the different functioning cycles of the machine 10, actuating a sequence which is substantially continuous.

It is also clear that, although the present invention has been described with reference to some specific examples, a person of skill in the art shall certainly be able to achieve many other equivalent forms of machine and method for the treatment of containers of liquids, and a closing device for said containers, having the characteristics as set forth in the claims and hence all coming within the field of protection defined thereby.

The invention claimed is:

1. A machine for treating containers (12) of liquids, the machine comprising:

a loading station (15) into which baskets (23) containing containers (12) to be subjected to treatment are loaded, the containers (12) being disposed in the baskets (23) according to a desired predetermined pattern of disposition;

a washing station (17) in which the containers (12) are subjected at least to washing;

a filling station (18) in which the washed containers (12) are filled with a liquid; and a re-closing station (19) in which the containers (12) are closed by relative lids (11), the re-closing station (19) comprising:

a closing device (63) provided with gripper members (70) by which the lids (11) are picked up and positioned to close the containers (12); and loading means (66) able to automatically direct the lids (11) toward the closing device (63) in a manner consistent with said desired predetermined pattern of disposition of the containers (12) in the baskets (23), said closing device (63) comprising movement means (69) able to move said gripper members (70) automatically between a pick-up position in correspondence with said loading means (66) and a position of closure of the lids (11) in correspondence with said containers (12), wherein the loading means (66) are configured to feed the lids (11) in a direction substantially parallel to a direction of feed (X) of the baskets (23) along the washing station, said loading means (66) comprise stop elements able to be selectively activated to automatically dispose the lids (11) in a manner consistent with the predetermined pattern of disposition of the containers (12), wherein each of the stop elements comprises at least a linear actuator (67) configured to act in a direction transverse to the direction of feed (X) in order to intercept a determinate lid and to stop the determinate lid in a predetermined position according to the pattern of disposition of the containers (12).

2. The machine as in claim 1, wherein the re-closing station (19) further comprises containing means able to contain the lids (11) to be repositioned, which are operatively associated with pick-up means (65) able to automatically pick up and transport the lids (11) from the containing means (61) toward the loading means (66).

3. The machine as in claim 1, wherein the loading means (66) further comprise at least a conveyor belt (80) conformed to move the lids (11) until the lids (11) cooperate with the stop elements.

4. The machine as in claim 3, further comprising:

a pick-up member (65) disposed upstream of the loading means (66) and able to automatically pick up the lids (11) from a relative containing hopper (61) and to position the lids (11) in a determinate order on said loading means (66).

5. The machine as in claim 4, wherein the conveyor belt (80) extends from the pick-up member (65) to the stop elements.

6. The machine as in claim 5, wherein said pick-up member (65) comprises a cursor element (64) along a guide or runner (68) which extends from inside the containing hopper (61) toward the loading means (66).

7. The machine as in claim 1, wherein said loading means further comprise a vibrating feed plane (66) toward the closing device (63).

8. The machine as in claim 1, further comprising:

sensor means (81) disposed in cooperation with the stop elements to identify an actual position of the lids (11) on the loading means (66), and to actuate selective activation of said stop elements.

9. The machine as in claim 1, wherein said movement means comprise a translator slider associated with said gripper members (70), to determine a movement of the gripper members (70) in a direction transverse to the direction of feed (X) of the baskets (23) along the washing station.

10. The machine as in claim 1, further comprising:

additional movement means (21, 22) able to determine the movement of the baskets (23) in the direction of feed (X) of the baskets (23) along the washing station, wherein the closing device (63) is suspended on a bridge structure (62) above the additional movement means (21, 22), which is provided with linear guides (71) transverse to direction of feed (X) along the machine, along which the sliding defined by the movement means (69) is achieved.

11. The machine as in claim 1, wherein the gripper members (70) of the closing device (63) are grouped together and disposed in a manner consistent with a pattern of disposition of the lids (11) in which the lids (11) are maintained by the linear actuators (67).

12. The machine as in claim 1, wherein the gripper members (70) are selectively movable in a vertical direction, by means of relative actuator means (72), in order to pick up the lids (11) from the loading means (66) and to subsequently position the lids (11) on the relative containers (12).

13. A loading device able to automatically direct relative lids (11) of containers (12) of liquids toward a closing device (63) in a manner consistent with a predetermined pattern of disposition of the containers (12) in baskets (23), the loading device comprising loading means (66) configured to feed the lids (11) in a direction substantially parallel to a direction of feed (X) of the baskets (23) and stop elements are selectively activated to automatically dispose the lids (11) in a manner consistent with the predetermined pattern of disposition of the containers (12), wherein each of the stop elements comprises at least a linear actuator (67) configured to act in a direction transverse to the direction of feed (X) in order to intercept a determinate lid and to stop the determinate lid in a predetermined position according to the pattern of disposition of the containers (12).

14. A method to treat containers (12) of liquids, the method comprising:

loading baskets (23) containing containers (12) to be subjected to treatment into a loading station (15), said containers (12) being disposed in the baskets (23) according to a desired predetermined pattern of disposition;

washing the containers (12);

filling the washed containers (12) with liquid;

re-closing the containers (12) with lids (11) such that the lids (11) are automatically disposed by loading means (66) in a manner consistent with said desired predetermined pattern of disposition of the containers (12) in the baskets (23), and feeding the lids (11) in a direction substantially parallel to a direction of feed (X) of the baskets (23), wherein the lids (11) are picked-up and positioned by a closing device (63) provided with gripper members (70) to close the containers (12), wherein said gripper members (70) are moved automatically by movement means (69) between a pick-up position in correspondence with said loading means (66) and a position of closure of the lids (11) in correspondence with said containers (12), and wherein the loading means (66) comprises stop elements each comprising at least a linear actuator (67), wherein each said linear actuator is selectively activated to automatically dispose the lids (11) in a manner consistent with the desired predetermined pattern of disposition of the containers (12), the linear actuator (67) acting in a direction transverse to the direction of feed (X) to intercept a determinate lid and to stop the determinate lid in a predetermined position according to the pattern of disposition of the containers (12).

* * * * *